US008695368B2

(12) United States Patent
Yoon et al.

(10) Patent No.: US 8,695,368 B2
(45) Date of Patent: Apr. 15, 2014

(54) REFRIGERATOR

(75) Inventors: Jongsoo Yoon, Gyeongnam (KR); Jonggon Kim, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 334 days.

(21) Appl. No.: 13/185,935

(22) Filed: Jul. 19, 2011

(65) Prior Publication Data

US 2012/0017623 A1 Jan. 26, 2012

(30) Foreign Application Priority Data

Jul. 20, 2010 (KR) ..... 10-2010-0069803

(51) Int. Cl.
*F25D 21/14* (2006.01)

(52) U.S. Cl.
USPC ..... 62/279; 62/273; 62/277; 62/285; 62/288; 62/289; 62/291

(58) Field of Classification Search
USPC ..... 62/277, 279, 272, 273, 285, 289, 291, 62/288
See application file for complete search history.

(56) References Cited

U.S. PATENT DOCUMENTS

| | | | | |
|---|---|---|---|---|
| 2,318,984 | A * | 5/1943 | Atchison | 62/288 |
| 4,239,518 | A * | 12/1980 | Steelman | 62/449 |
| 5,097,897 | A | 3/1992 | Watanabe et al. | |
| 5,199,273 | A * | 4/1993 | Silva et al. | 62/298 |
| 5,284,023 | A | 2/1994 | Silva et al. | |
| 6,631,623 | B1 * | 10/2003 | Ball | 62/285 |
| 2004/0182100 | A1 * | 9/2004 | Lee et al. | 62/285 |
| 2008/0223063 | A1 * | 9/2008 | Jeong et al. | 62/291 |

FOREIGN PATENT DOCUMENTS

| | | | |
|---|---|---|---|
| CN | 201387195 | Y | 1/2010 |
| EP | 1 783 445 | A1 | 5/2007 |
| JP | 2006-162163 | A | 6/2006 |
| JP | 2006-234354 | A | 9/2006 |

OTHER PUBLICATIONS

Chinese Office Action dated Jul. 2, 2013 for Application No. 201110259767.2, with English Translation, 19 pages.
European Search Report dated Apr. 25, 2013 for Application No. 11174327.4, 6 pages.

* cited by examiner

*Primary Examiner* — Allana Lewin
*Assistant Examiner* — Kun Kai Ma
(74) *Attorney, Agent, or Firm* — Fish & Richardson P.C.

(57) ABSTRACT

A refrigerator is disclosed, which is able to more desirably carry out a heat exchange action between a hot pipe and a drain guide pipe, which guides defrosting water. The refrigerator comprises a cool air generating chamber and a machine chamber provided above a main body; a defrosting water tray provided inside the cool air generating chamber; a water collecting tray provided below the main body; a hot pipe connecting a compressor with a condenser through the water collecting tray, the compressor and the condenser being provided in the machine chamber; and a drain guide pipe mounted outside the main body and connected to the defrosting water tray and the water collecting tray to guide the defrosting water discharged from the defrosting water tray to the water collecting tray, wherein the hot pipe is provided inside or outside the drain guide pipe.

16 Claims, 5 Drawing Sheets

REFRIGERATOR

CROSS REFERENCE TO RELATED APPLICATION

This application claims the benefit of the Korean Patent Application No. 10-2010-0069803, filed on Jul. 20, 2010 which is hereby incorporated by reference as if fully set forth herein.

BACKGROUND OF THE INVENTION

1. Field of the Invention

The present invention relates to a refrigerator, and more particularly, to a refrigerator that is able to carry out a heat exchange action between a hot pipe and a drain guide pipe more desirably, wherein the drain guide pipe guides defrosting water.

2. Discussion of the Related Art

A refrigerator is a home appliance that stores food in a storage chamber at a low temperature by using a refrigerant cycle.

Specifically, the refrigerator comprises a main body, a cool air generating chamber provided in the main body, having an evaporator to generate the cool air, and a machine chamber provided with a compressor and a condenser.

The cool air generating chamber is provided with a defrosting water tray that receives defrosting water generated in the evaporator during a defrosting action. The defrosting water is collected in the defrosting water tray in such a manner that it downwardly moves along a drain guide pipe connected to the defrosting water tray and is collected in a water collecting tray provided below the main body.

The compressor and the condenser are connected with each other by a hot pipe, which guides a refrigerant discharged from the compressor to the condenser. The refrigerant discharged from the compressor is at a high temperature state, whereby the hot pipe has a very high surface temperature.

The hot pipe is connected with the compressor such that it is arranged inside or outside the main body, whereby the hot pipe is connected with the condenser through the water collecting tray. As a result, the hot pipe can prevent condensation from occurring on the surface of the main body, and can serve to evaporate the water collected in the water collecting tray.

However, the refrigerator according to the related art has a problem in that the hot pipe is spaced apart from the drain guide pipe for guiding defrosting water, so as not to carry out heat exchange therebetween.

SUMMARY OF THE INVENTION

Accordingly, the present invention is directed to a refrigerator that substantially obviates one or more problems due to limitations and disadvantages of the related art.

An object of the present invention is to provide a refrigerator that is able to carry out a heat exchange action between a hot pipe and a drain guide pipe, which guides defrosting water, whereby an evaporation action of defrosting water flowing along the drain guide pipe can be carried out more desirably.

Another object of the present invention is to provide a refrigerator that does not need a separate fixing member for fixing a hot pipe by providing the hot pipe outside defrosting water or receiving the hot pipe inside the defrosting water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator according to the present invention comprises a cool air generating chamber and a machine chamber provided above a main body; a defrosting water tray provided inside the cool air generating chamber; a water collecting tray provided below the main body; a hot pipe connecting a compressor with a condenser through the water collecting tray, the compressor and the condenser being provided in the machine chamber; and a drain guide pipe mounted outside the main body and connected to the defrosting water tray and the water collecting tray to guide the defrosting water discharged from the defrosting water tray to the water collecting tray, wherein the hot pipe is provided inside or outside the drain guide pipe.

As described above, the refrigerator according to the present invention has advantages as follows.

The refrigerator is able to carry out a heat exchange action between the hot pipe and the drain guide pipe, which guides defrosting water, whereby an evaporation action of defrosting water flowing along the drain guide pipe can be carried out more desirably.

Also, the refrigerator does not need a separate fixing member for fixing the hot pipe by providing the hot pipe outside defrosting water or receiving the hot pipe inside the defrosting water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
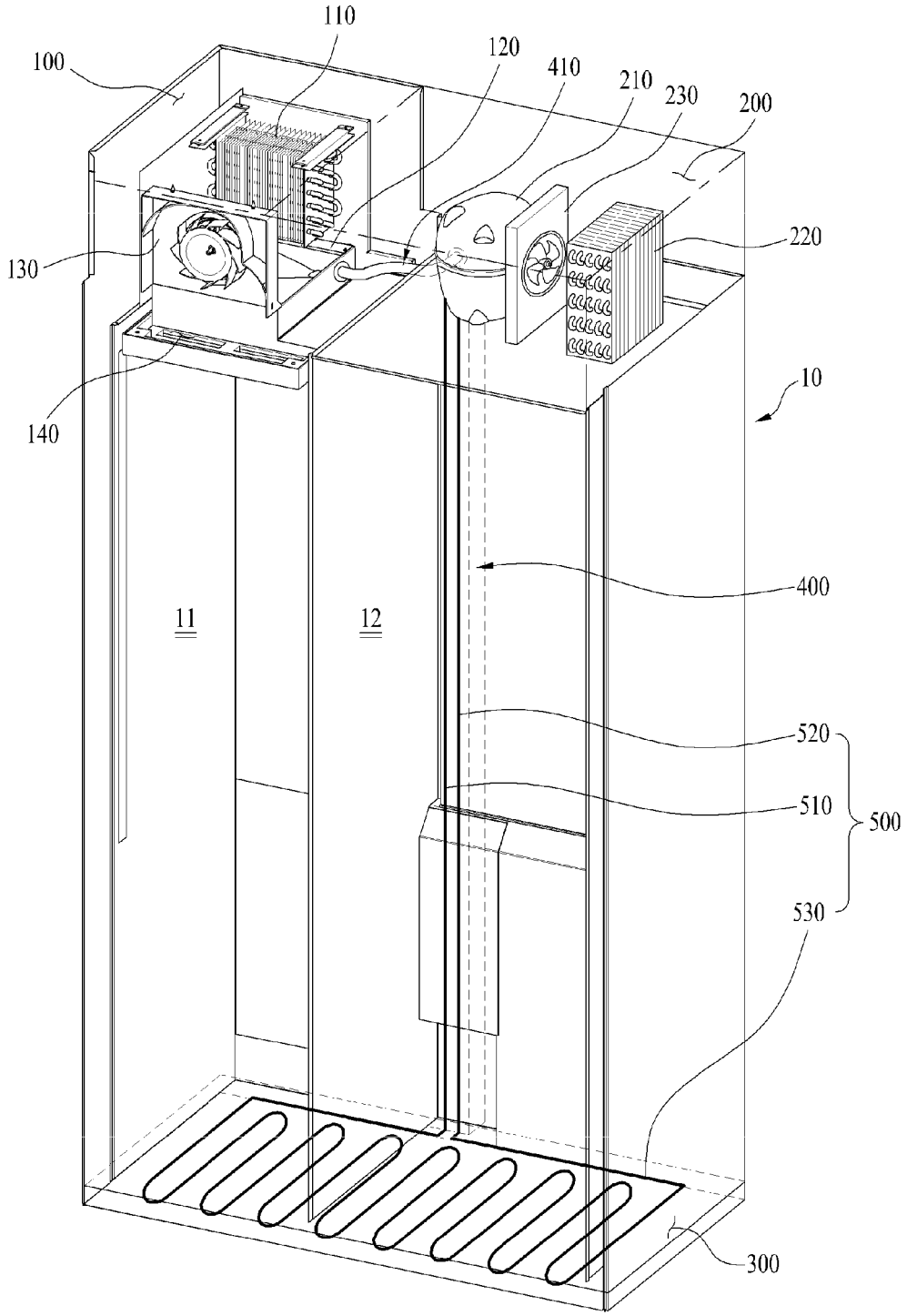
FIG. 1 is a front perspective view illustrating a refrigerator according to the present invention.

As shown in FIG. 1, a refrigerator according to the present invention includes a main body 10, a freezing chamber 11 and a refrigerating chamber 12. A cool air generating chamber 100 is provided above the freezing chamber 11, and a machine chamber 200 is provided above the refrigerating chamber 12.

The cool air generating chamber 100 includes an evaporator 110, a defrosting water tray 120 and a cool air fan unit 130.

The defrosting water tray 120 is provided below the evaporator 110 to collect defrosting water generated by the evaporator 110 when a defrosting action of the evaporator 110 occurs.

The cool air fan unit 130 is arranged at the front of the evaporator 110, and serves to pull up the air in the freezing chamber 11 so as to carry out heat exchange between the air and the evaporator 110 and then send the cooled air to the freezing chamber.

A discharge outlet 140 is provided at the front of the cool air fan unit 130 to discharge the air of the freezing chamber, and a suction inlet (not shown) is provided at the rear of the evaporator 110 to suck the air of the freezing chamber 11 towards the evaporator 110.

In the mean time, a water collecting tray 300 is provided below the main body 10 to collect defrosting water collected in the defrosting water tray 120.

The defrosting water collected in the defrosting water tray 120 moves under the guide of a drain guide pipe 400 and a connection pipe 410, wherein the drain guide pipe 400 is arranged outside the rear of the main body 10, and the connection pipe 410 connects the drain guide pipe 400 with the defrosting water tray 120.

A mounting groove (not shown) having a shape corresponding to a sectional shape of the drain guide pipe 400 is provided at the rear of the body 10 to mount the drain guide pipe 400. Accordingly, the drain guide pipe 400 is mounted in and fixed to the mounting groove (not shown).

The drain guide pipe 400 is arranged up and down outside the rear of the main body 10.

The upper side of the drain guide pipe 400 is connected with the connection pipe 410, and the lower side of the drain guide pipe 400 is connected with the water collecting tray 300.

In the mean time, the machine chamber 200 is partitioned from the cool air generating chamber 100 and arranged next to the cool air generating chamber 100.

A compressor 210 compressing a refrigerant, a condenser 220 condensing the compressed refrigerant, and a condensing fan 230 provided next to the condenser 220 to blow the air to the condenser 220 are provided in the cool air generating chamber.

The compressor 210 and the condenser 220 are connected with each other through a hot pipe 500. The hot pipe 500 is connected with the compressor 210 and the condenser 220 and arranged along the rear outside of the main body 10. In more detail, the hot pipe 500 is arranged over a certain area inside the water collecting tray 300 provided below the main body 10.

In other words, the hot pipe 500 includes a first hot pipe 510 connected with the compressor 210, a second hot pipe 520 connected with the condenser 220, and a third hot pipe 530 extended from the first and second hot pipes 510 and 520 connected with the compressor 210 and the condenser 220 and arranged over a predetermined area of the water collecting tray 300.

The refrigerant discharged from the compressor 210 downwardly moves along the first hot pipe 510 and then moves to the third hot pipe 530. Afterwards, the refrigerant enters the second hot pipe 520 and moves to the condenser 220 under the guide of the second hot pipe 520.

Since the cool air inside the first to third hot pipes 510, 520 and 530 is at a high temperature state, if the cool air is in contact with the defrosting water in the drain guide pipe 400 and the water collecting tray 300, it may evaporate the defrosting water.

In particular, since the third hot pipe 530 arranged in the water collecting tray 300 is widely arranged over the surface of the water collecting tray 300 and maintains at a high surface temperature due to the refrigerant of high temperature as described above, it serves to transfer heat to the collected defrosting water widely spread in the surface of the water collecting tray 300 and evaporate the defrosting water.

The first and second hot pipes 510 and 520 arranged at the rear of the main body 10 may be received in the drain guide pipe 400 or may be coupled to the external surface of the drain guide pipe 400.

This is to enable heat exchange between the first and second hot pipes 510 and 520 and the drain guide pipe 400 or heat exchange between the first and second hot pipes 510 and 520 and the defrosting water flowing inside the drain guide pipe 400.

If the temperature of the drain guide pipe 400 ascends in accordance with heat exchange between the first and second hot pipes 510 and 520 and the drain guide pipe 400, the defrosting water inside the drain guide pipe 400 may be evaporated naturally.

In the mean time, since the first and second hot pipes 510 and 520 are mounted inside the drain guide pipe 400 or on the external surface of the drain guide pipe 400, a separate mounting structure such as a clip or holder for fixing the first and second hot pipes 510 and 520 to the main body is not required.

The hot pipe 500 mounted in the drain guide pipe 400 includes the first hot pipe 510 connected with the compressor 210 and the second hot pipe 520 connected with the condenser 220 as described above. Preferably, the first and second hot pipes 510 and 520 are provided up and down in parallel with the drain guide pipe 400.

Figure 2:
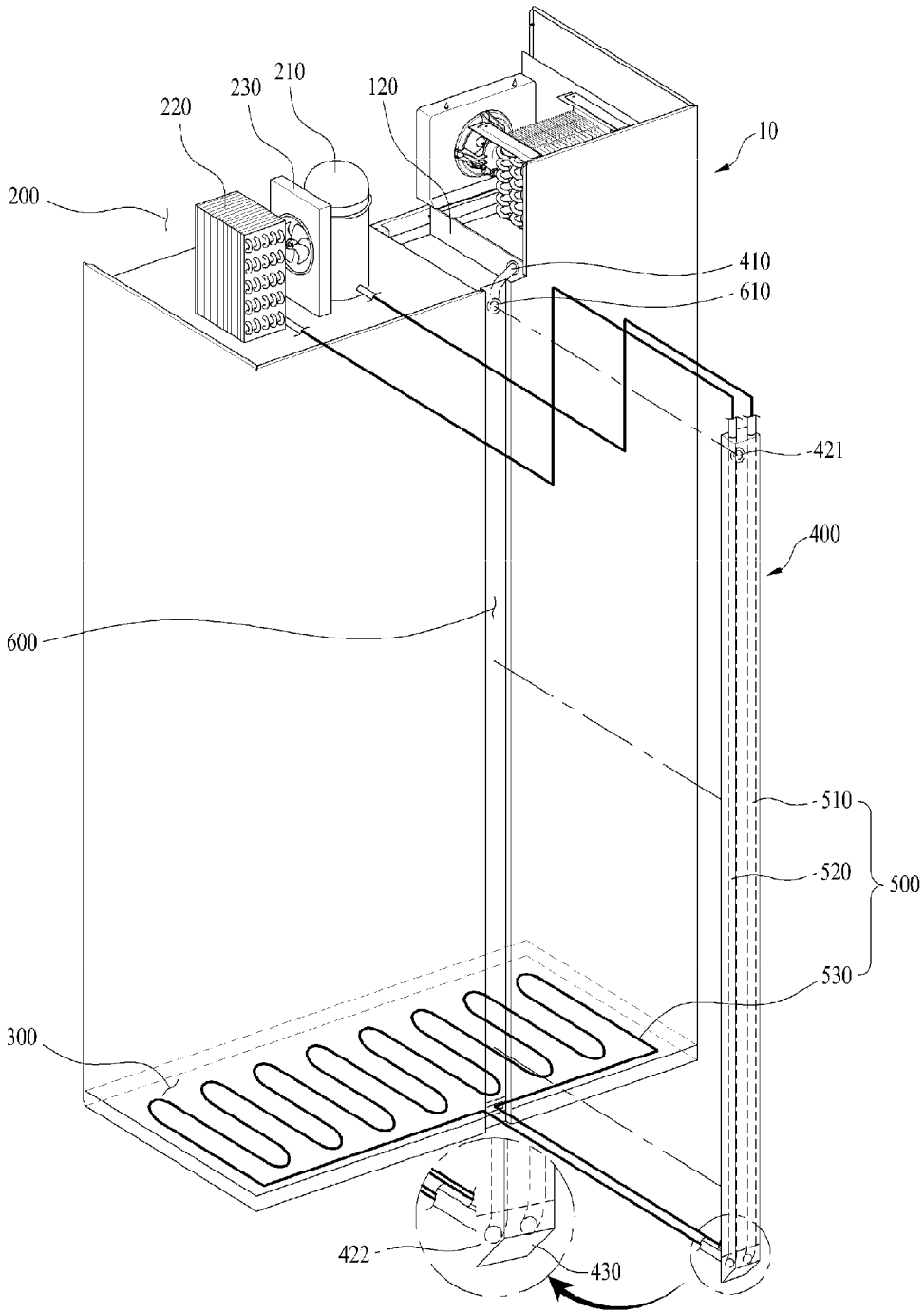
FIG. 2 is a rear perspective view illustrating a refrigerator according to the present invention.

As shown in FIG. 2, a mounting groove 600 is arranged up and down outside the rear of the main body 10, and the drain guide pipe 400 is also arranged up and down in the mounting groove 600.

In this case, a connection hole 610 is provided above the mounting groove 600, wherein one end of the connection pipe 410 connected with the defrosting water tray 120 is mounted in the connection hole 610.

After the defrosting water collected in the defrosting water tray 120 is guided by the connection pipe 410, it moves to the drain guide pipe 400 by passing through the connection hole 610.

An inlet 421 is formed at one side above the drain guide pipe 400 and is connected with the connection hole 610 to flow the defrosting water thereinto.

An outlet 422 is provided at one side below the drain guide pipe 400 and is connected with the water collecting tray 300 provided below the main body 10 to discharge the water in the drain guide pipe 400 towards the water collecting tray.

Preferably, the drain guide pipe 400 has a hollow rectangular shape and the mounting groove 600 also has a hollow rectangular shape corresponding to the shape of the drain guide pipe 400.

However, it is to be understood that the shape of the drain guide pipe 400 is not limited to the rectangular shape. Namely, various modifications can be made in the shape of the drain guide pipe 400. For example, the drain guide pipe 400 may have a cylindrical shape and the mounting groove 600 may also have a cylindrical shape corresponding to the shape of the drain guide pipe 400.

An incline portion 430 is formed below the drain guide pipe 400 and guides the defrosting water in the drain guide pipe 400 to be dropped down, whereby the defrosting water can easily be moved to the water collecting tray 300.

The incline portion 430 is downwardly inclined towards the front from the rear to prevent the defrosting water from remaining below the drain guide pipe 400.

Also, the incline portion 430 serves to guide the defrosting water to be quickly moved to the water collecting tray 300 in such a manner that the defrosting water downwardly moves along the incline portion 430.

The hot pipe 500, as described above, includes the first hot pipe 510 connected with the compressor 210, the second hot pipe 520 connected with the condenser 220, and the third hot pipe 530 arranged inside the water collecting tray 300.

In this case, the first hot pipe 510 connected with the compressor 210 and the second hot pipe 520 connected with the condenser 220 are projected from the inside of the machine chamber 200 to the outside thereof, and pass through the upper surface of the drain guide pipe 400 or one side above the drain guide pipe 400.

And, the first hot pipe 510 and the second hot pipe 520 are connected with the third hot pipe 530 arranged inside the water collecting tray 300 by passing through the outlet 422 provided below the drain guide pipe 400.

The third hot pipe 530 is windingly arranged in the water collecting tray 300 to occupy a certain area inside the water collecting tray 300, whereby the third hot pipe 530 can be easily in contact with the defrosting water collected in the water collecting tray 300.

Figure 3:
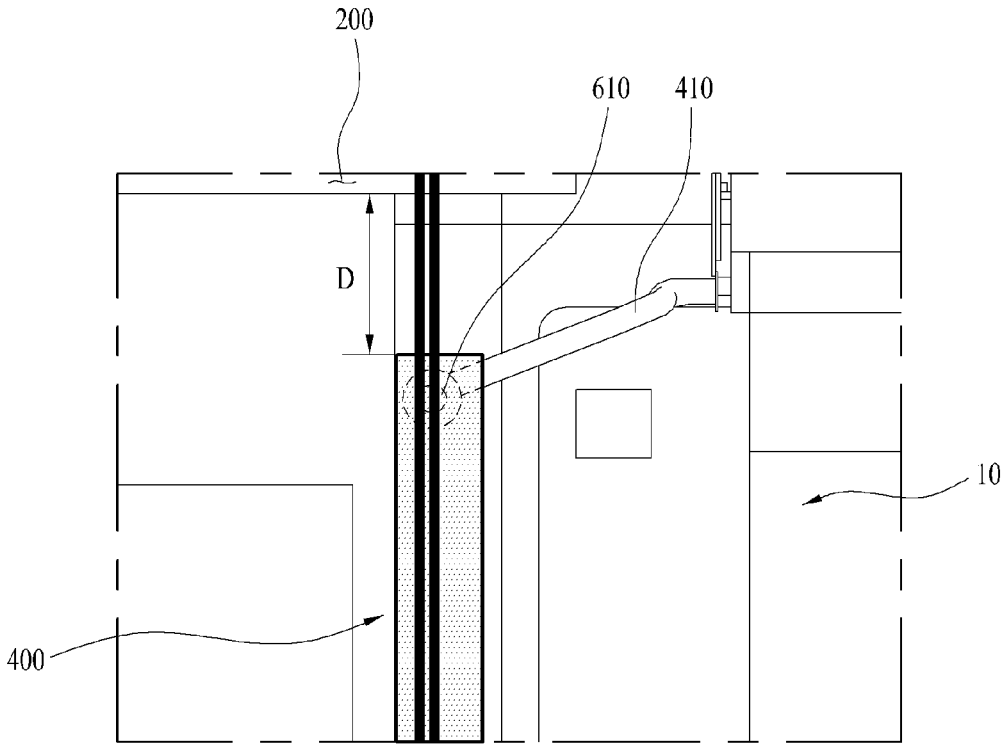
FIG. 3 is a rear view illustrating a state that a drain guide pipe and a hot pipe are provided in a refrigerator according to the present invention.

As shown in FIG. 3, it is preferable that the upper end of the drain guide pipe 400 is not extended to the upper end of the main body 10 but spaced apart from the lower end of the machine chamber 200 as much as a certain distance D.

This considers that the connection hole 610 is lower than the lower end of the machine chamber 200.

In other words, if the upper end of the drain guide pipe 400 is remarkably higher than the connection hole 610, since the distance between the upper end of the drain guide pipe 400 and the connection hole 610 is not a space where the water can move, it may be a dead space.

Accordingly, in order to prevent unnecessary materials from being used, the upper end of the drain guide pipe 400 is located directly above the connection hole 610.

The connection hole 610 is arranged to be a little lower than the discharge outlet of the defrosting water tray 120.

This is to easily move the defrosting water discharged from the discharge outlet of the defrosting water tray 120 to the connection hole 421 (see FIG. 2) along the connection pipe 410.

One end of the connection pipe 410 is arranged at the discharge outlet of the defrosting water tray 120, and the other end of the connection pipe 410 is arranged to be connected with the connection hole 610.

Figure 4:
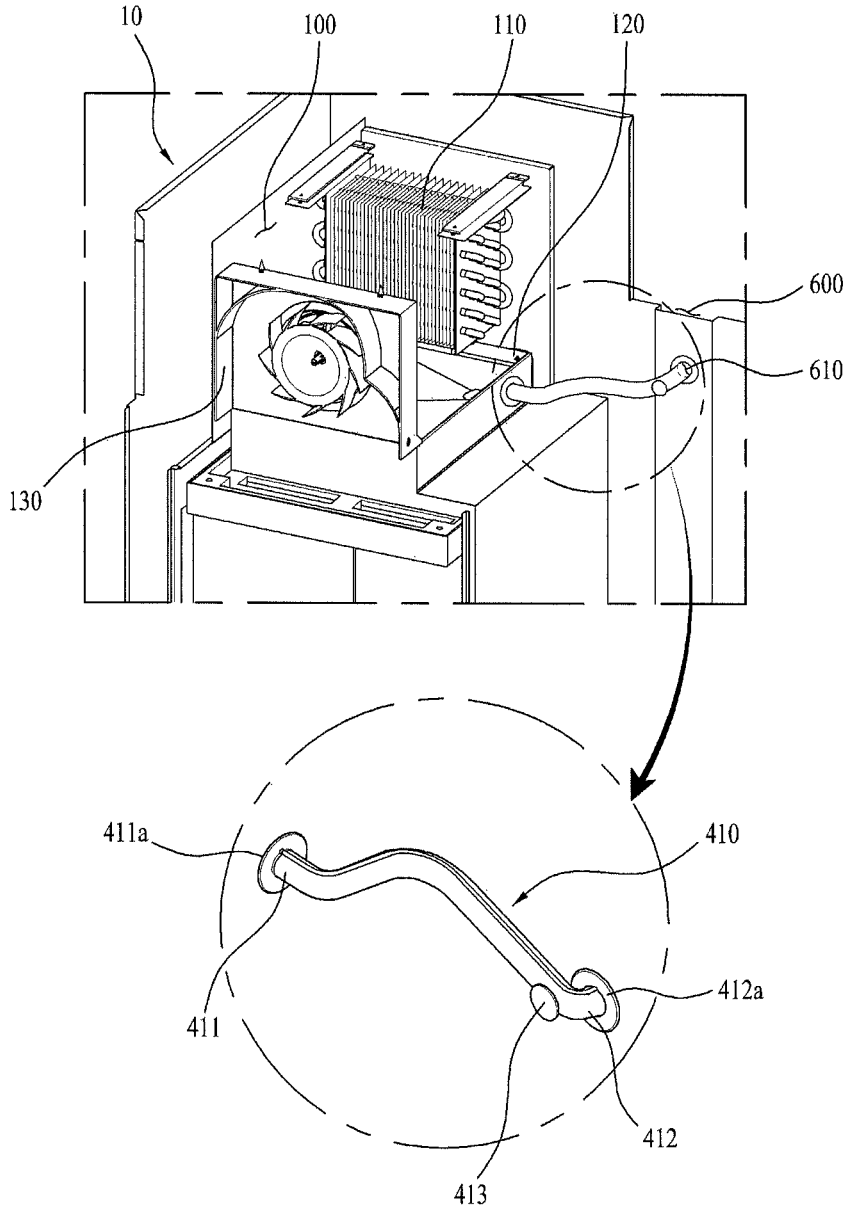
FIG. 4 is a perspective view illustrating a state that a connection pipe is provided in a refrigerator according to the present invention.

As shown in FIG. 4, the connection pipe 411 includes one end 411 connected with the discharge outlet provided at a side of the defrosting water tray 120 and the other end 412 connected with the connection hole, as described above.

Considering the limit of the space above the main body 10 and the cool air generating chamber 100, it is preferable that there is a difference in height between the one end 411 and the other end 412. It is also preferable that the connection pipe 411 partially has a winding shape.

The connection pipe 411 has a winding shape to prevent the defrosting water from flowing too fast while receiving the defrosting water much more than that received in a straight shape pipe. In other words, the connection pipe 411 is windingly formed to control velocity of flow of the defrosting water.

It is preferable that the one end 411 is higher than the other end 412 to easily move the defrosting water flown into the one end 411 to the drain guide pipe 400 after moving the defrosting water to the other end 412.

Support portions 411*a* and 412*a* are respectively provided at the one end 411 and the other end 412 of the connection pipe 410. The support portions 411*a* and 412*a* are in surface contact with the side of the defrosting water tray 120 and the inside of the main body 10 where the connection hole 610 is formed.

Although the support portions 411*a* and 412*a* are provided in a cylindrical shape, their shape is not limited to the cylindrical shape. The support portions 411*a* and 412*a* may be provided in other shape such as a rectangular shape.

Each of the support portions 411*a* and 412*a* has a size greater than a diameter of the drain guide pipe 410 arranged between the support portions 411*a* and 412*a*.

Since each of the support portions 411*a* and 412*a* has a surface area, the surface of each of the support portions 411*a* and 412*a* can be coated with an adhesive, whereby the support portions 411*a* and 412*a* can easily be attached into the main body 10 and the defrosting water tray 120.

In the mean time, a side support portion 413 is provided at a portion adjacent to the other end 412 of the connection pipe 410 in a plate shape. The side support portion 413 is in surface contact with the outside of an inner case of the refrigerator.

Accordingly, the support portion 412*a* provided at the other end of the connection pipe 410 is attached to an inner wall of an outer case constituting the main body, and the side support portion 413 is supported to the outer wall of the inner case arranged inside the outer case.

Figure 5:
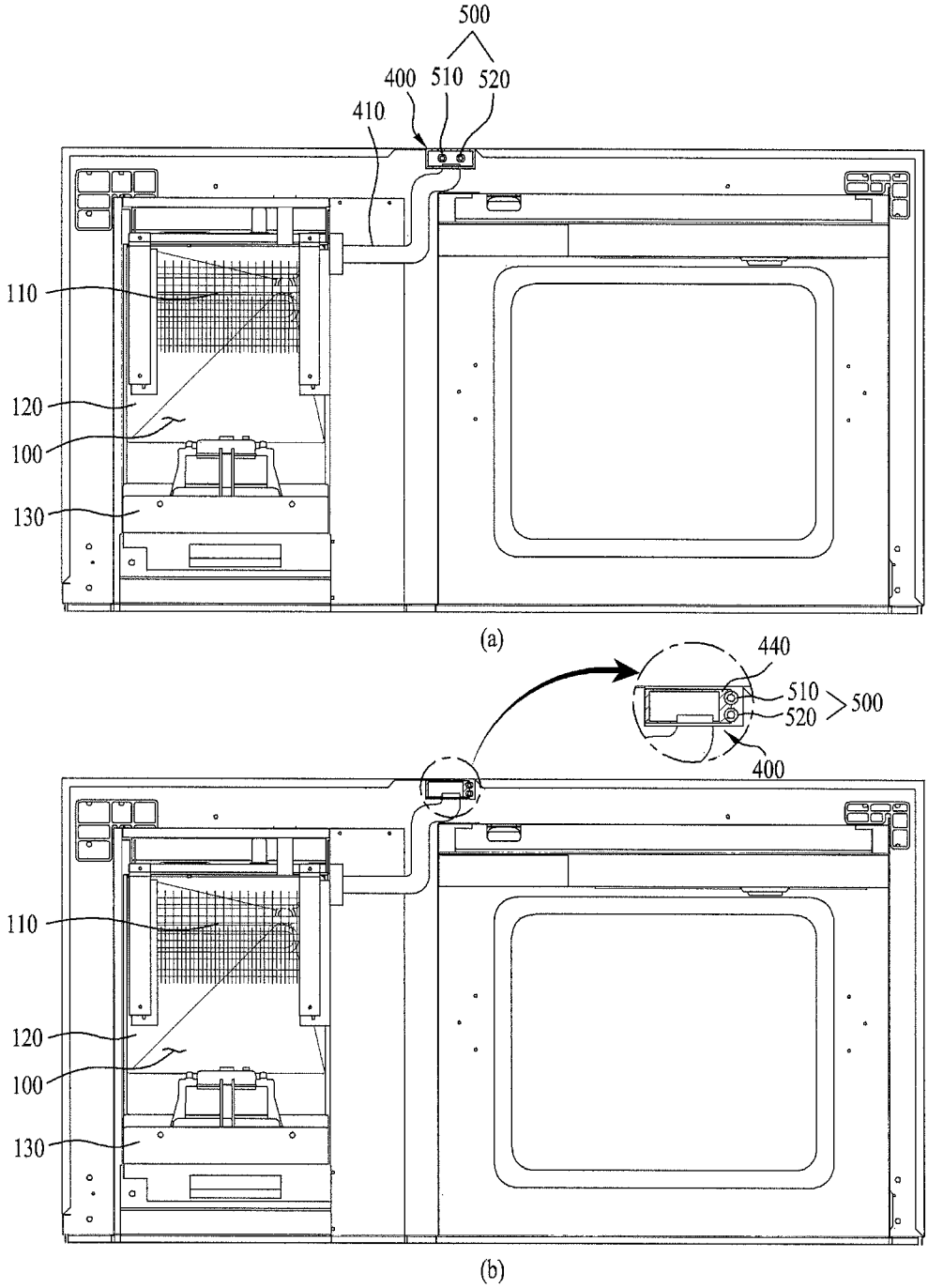
FIG. 5 is a plane sectional view illustrating a refrigerator according to the present invention.

As shown in FIG. 5(*a*), the hot pipe 500 is arranged inside the drain guide pipe 400 in parallel with the drain guide pipe 400 so as to be in contact with the defrosting water flowing inside the drain guide pipe 400, whereby it can evaporate the defrosting water.

Also, if the refrigerant flowing inside the hot pipe 500 carries out heat exchange with the defrosting water, since its temperature may be lower, condensing efficiency at the condenser can be enhanced.

In the mean time, as shown in FIG. 5(*b*), the hot pipe 500 is fitted into a groove shaped fixing portion 440 provided on the external surface of the drain guide pipe 400 to carry out heat exchange with the drain guide pipe 400.

As described above, if the hot pipe 500 is arranged on the external surface of the drain guide pipe 400, it is advantageous in that the defrosting water flows to carry out heat exchange with the external air as well as the drain guide pipe 400 of which temperature has been lowered.

Hereinafter, the operation of the refrigerator according to the present invention will be described with reference to the accompanying drawings.

If a cool air generating action of the evaporator 110 disclosed in FIG. 1 is stopped and a defrosting heater (not shown) provided in the evaporator 110 carries out defrosting action for removing frost formed in the evaporator 110, the frost is melted and becomes a defrosting water, and the defrosting water is dropped in the defrosting water tray 120 and collected therein.

Since the bottom surface of the defrosting water tray 120 is included towards an outlet provided in the defrosting water tray 120 and connected with the connection pipe 120, the defrosting water moves to the outlet. The defrosting water that has passed through the outlet flows into the drain guide pipe 400 under the guide of the connection pipe 410.

The defrosting water flown into the drain guide pipe 400 downwardly moves under the guide of the drain guide pipe 400 and is collected in the water collecting tray 300.

At this time, since the surface of the hot pipe 500 mounted inside the drain guide pipe 400 or on the external surface of the drain guide pipe 400 has a high temperature due to heat of the refrigerant, if the defrosting water inside the hot pipe 500 and the drain guide pipe 400 or the defrosting water in the water collecting tray 120 is in contact with the hot pipe 500, the defrosting water can be evaporated.

In the mean time, since the hot pipe 500 is mounted to pass through the inside of the drain guide pipe 400, or is fixed to the outside of the drain guide pipe, a separate fixing structure for fixing the hot pipe 400 is not required.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A refrigerator comprising:

a main body provided with a storing chamber therein;

a cool air generating chamber supplying cool air to the storing chamber and a machine chamber provided with a compressor and a condenser, the cool air generating chamber and the machine chamber being provided above the main body;

a defrosting water tray provided inside the cool air generating chamber and mounted on a top surface of the main body;

a water collecting tray provided below the main body;

a hot pipe connecting the compressor with the condenser through the water collecting tray;

a drain guide pipe mounted outside the main body and connected to the defrosting water tray and the water collecting tray to guide the defrosting water discharged from the defrosting water tray to the water collecting tray, wherein the hot pipe is provided inside or outside the drain guide pipe;

a mounting groove provided on a rear surface of the main body to mount the drain guide pipe therein, wherein the mounting groove is arranged up and down on the rear surface of the main body to arrange the drain guide pipe up and down with respect to the main body;

a connection hole provided in the mounting groove, wherein the defrosting water discharged from the defrosting water tray passes through the connection hole;

an inlet formed at one side of the drain guide pipe to correspond to the location of the connection hole and guide the defrosting water to the drain guide pipe; and an outlet provided below the drain guide pipe to guide the defrosting water flown into the drain guide pipe to the water collecting tray, wherein the hot pipe comprises a first hot pipe connected with the compressor provided inside the machine chamber, a second hot pipe connected with the condenser provided inside the machine chamber, and a third hot pipe connecting the first and second hot pipes with each other, arranged over a predetermined area of the water collecting tray, and the first and second hot pipes are arranged up and down in the drain guide pipe.

2. The refrigerator as claimed in claim 1, wherein the mounting groove is arranged on a boundary line between a lower portion of the machine chamber and a lower portion of the cool air generating chamber, and the drain guide pipe is arranged along the mounting groove between the lower portion of the machine chamber and the lower portion of the cool air generating chamber.

3. The refrigerator as claimed in claim 1, further comprising an incline portion provided on a lower surface of the drain guide pipe to guide the defrosting water in the lower surface of the drain guide pipe to the water collecting tray.

4. The refrigerator as claimed in claim 1, wherein the first and second hot pipes are arranged up and down along an inner space of the drain guide pipe by passing through an upper surface of the drain guide pipe, and are connected with the third hot pipe through the outlet.

5. The refrigerator as claimed in claim 1, wherein the first and second hot pipes are arranged to be in contact with the surface of the drain guide pipe.

6. The refrigerator as claimed in claim 5, further comprising a fixing portion provided in the drain guide pipe, wherein the hot pipe is fixedly fitted into the fixing portion.

7. The refrigerator as claimed in claim 2, wherein an upper end portion of the drain guide pipe is downwardly spaced apart from the boundary line between the machine chamber and the cool air generating chamber at a predetermined interval.

8. The refrigerator as claimed in claim 1, further comprising a connection pipe connecting the defrosting water tray with the drain guide pipe to guide the defrosting water discharged from the defrosting water tray to the drain guide pipe.

9. The refrigerator as claimed in claim 8, wherein the connection pipe includes one end connected with a discharge outlet provided at a side of the defrosting water tray and the other end connected with the connection hole of the drain guide pipe, the one end being higher than the other end to allow the defrosting water flown into the one end to move to the other end.

10. The refrigerator as claimed in claim 9, further comprising a support portion provided in the one end and the other end of the connection pipe in surface contact with an inner wall of the main body and the defrosting water tray.

11. The refrigerator as claimed in claim 10, further comprising a side support portion provided in the connection pipe, wherein the support portion provided in the other end of the connection pipe is supported towards an inner surface of an outer case constituting the main body, and the side support portion is supported towards an outer surface of an inner case arranged inside the outer case.

12. The refrigerator as claimed in claim 8, wherein the connection pipe is windingly formed.

13. A refrigerator comprising:

a cool air generating chamber provided above a main body, having an evaporator and a cool air fan unit;

a machine chamber provided with a compressor and a condenser;

a defrosting water tray provided inside the cool air generating chamber and below the evaporator;

a water collecting tray provided below the main body;

a hot pipe connecting the compressor with the condenser through the water collecting tray;

a drain guide pipe mounted outside the main body and connected to the defrosting water tray and the water collecting tray to guide the defrosting water discharged from the defrosting water tray to the water collecting tray, wherein the hot pipe is provided inside or outside the drain guide pipe;

a connection pipe connecting the defrosting water tray with the drain guide pipe to guide the defrosting water discharged from the defrosting water tray to the drain guide pipe; and a mounting groove provided on a rear surface of the main body to mount the drain guide pipe therein, wherein the mounting groove is arranged up and down on the rear surface of the main body to arrange the drain guide pipe up and down with respect to the main body, wherein the hot pipe includes a first hot pipe connected with the compressor provided inside the machine chamber, a second hot pipe connected with the condenser provided inside the machine chamber, and a third hot pipe connecting the first and second hot pipes with each other, arranged over a predetermined area of the water collecting tray, and the first and second hot pipes are arranged up and down in the drain guide pipe.

14. The refrigerator as claimed in claim 13, wherein the first and second hot pipes are arranged up and down along an inner space of the drain guide pipe by passing through an upper surface of the drain guide pipe, and are connected with the third hot pipe through the outlet.

15. The refrigerator as claimed in claim 13, further comprising an incline portion provided on a lower surface of the drain guide pipe to guide the defrosting water in the lower surface of the drain guide pipe to the water collecting tray.

16. The refrigerator as claimed in claim 13, wherein the connection pipe includes one end connected with a discharge outlet provided at a side of the defrosting water tray and the other end connected with a connection hole of the drain guide pipe, the one end being higher than the other end to allow the defrosting water flown into the one end to move to the other end.

* * * * *